US005579948A

United States Patent [19]

Lin

[11] Patent Number: 5,579,948

[45] Date of Patent: Dec. 3, 1996

[54] BEVERAGE CONTAINER WITH EXTENDABLE DRINKING STRAW

[75] Inventor: Bang H. Lin, Taipei, Taiwan

[73] Assignee: Shing Hong Industrial Co., Ltd., Tainan, Taiwan

[21] Appl. No.: 548,691

[22] Filed: Oct. 26, 1995

[51] Int. Cl.[6] ..... B65D 47/12

[52] U.S. Cl. ..... 220/707; 220/708; 215/229

[58] Field of Search ..... 220/707, 708, 220/705, 715; 215/229; 222/530

[56] References Cited

U.S. PATENT DOCUMENTS

| | | | |
|---|---|---|---|
| 4,852,762 | 8/1989 | Chou-Sheng | 215/229 X |
| 5,150,815 | 9/1992 | Saklad | 220/708 |
| 5,203,468 | 4/1993 | Hsu | 220/708 X |
| 5,265,757 | 11/1993 | Wu | 220/708 X |
| 5,273,172 | 12/1993 | Rossbach et al. | 220/708 X |
| 5,337,918 | 8/1994 | Wang | 220/708 |
| 5,339,982 | 8/1994 | Tardie | 220/708 |
| 5,346,081 | 9/1994 | Lin | 220/708 X |
| 5,484,080 | 1/1996 | Blasnik et al. | 220/708 |
| 5,497,901 | 3/1996 | Chen | 220/708 |
| 5,518,142 | 5/1996 | Lin | 220/707 |

*Primary Examiner*—Steven M. Pollard

*Attorney, Agent, or Firm*—Beveridge, Degrandi, Weilacher & Young, LLP

[57] ABSTRACT

A beverage container with a rotatable dome 4 and an extendable drinking upper straw 3. The container comprises an open ended body 1 closed by a removable cap 2, upper straw means 3 linearly movably fitted on the cap, a dome 4 rotatably fitted on the cap 2 for rotation movement relative to the cap 2, and link means (45, 32) for translating the rotational movement of the dome 4 into the linear movement of the upper straw means 3 on the cap 2, whereby the rotation of the dome 4 causes the upper straw means 3 to linearly move on the cap 2 between a first position wherein the tube section 31 of the upper straw means 3 extends through the lateral opening 28 of the cap 2 and the elongate slot 422 of the dome 4 and is in liquid communication with the nipple 284 of the cap 2, and a second position wherein the tube section 31 of the upper straw means 3 is withdrawn within the dome 4 and is not in liquid communication with the nipple 284 of the cap 2.

7 Claims, 7 Drawing Sheets

BEVERAGE CONTAINER WITH EXTENDABLE DRINKING STRAW

The invention relates to a beverage container with a rotatable cover and an extensible drinking straw.

BACKGROUND OF THE INVENTION

Beverage containers with automatically extensible drinking straws and decorative objects to attract users are known, for example, those disclosed in U.S. Pat. No. 5,150,815 assigned to Selandia Designs and U.S. patent application Ser. No. 08/231,93 filed on Apr. 25, 1994 and assigned to the assignee of the present invention. U.S. Pat. No. 5,180,815 teaches a drink container having spaced apart transparent shells with the intervening space containing a liquid and floatable and sinkable decorative objects. A cap and a cover on the container open top are rotatable between a drinking position where a sipping straw extends upwardly for use and a non-drinking position where the straw is moved within the cover and pinched off to prevent leakage.

U.S. patent application Ser. No. 08/231,93 relates to a beverage container wherein a cover is rotatable on a cap between a drinking position where a sipping straw extends inclinedly outwardly for use and a non-drinking position where the straw is moved within the cover and pinched off to prevent leakage. The cap includes a convex wall dimensioned to closed a slot in the cover tightly when the cover is in the non-drinking position. The cover is also adapted to mount a decorative object like cartoon figure thereon.

However, in either the '815 patent or the '693 application, the rotatable cover needs to be turned at specified rotation direction (clockwise or counterclockwise) and limited rotation angle (less then 180 degree) in order to have the drinking straw pop-out or folded and stored.

SUMMARY OF THE INVENTION

A primary object of the present invention is to provide an improved beverage container with an automatically extensible straw the novel structure of which is such that the straw may be linearly moved between a drinking position and a non-drinking position by a dome which can be rotated a 360 degree revolution on a cap. Also an object of the present invention is to provide an attractive beverage container on which the cap is provided with decorative patters or characters that can be viewed by a user through a slot and an opening in the rotatable dome upon the rotation of the dome.

Thus, the present invention provides a beverage container comprising:

a body having an open top end;

a removable cap for closing the top open end of the body and including a cylindrical side wall having a lateral opening and a top member having an coupler which has one end projecting from the underside of the top member to form a nipple;

a dip tube secured to the nipple and extending into the body;

an upper straw means linearly movable on the cap and including a tube section and a guide section;

a dome including a top member and a cylindrical side wall having an elongate slot partially extending around the side wall;

connector means for mounting the dome on the cap for rotational movement relative to the cap; and link means for translating the rotational movement of the dome into the linear movement of the upper straw means on the cap, whereby the rotation of the dome causes the upper straw means to linearly move on the cap between a drinking position wherein the tube section of the upper straw means extends through the lateral opening of the cap and the elongate slot of the dome and is in liquid communication with the nipple of the cap, and a non-drinking position wherein the tube section of the upper straw means is withdrawn within the dome and is not in liquid communication with the nipple of the cap.

BRIEF DESCRIPTION OF DRAWINGS

The invention will be described in greater detail with reference to the accompanying drawings, which illustrate preferred embodiment of the invention, and wherein.

DETAILED DESCRIPTION OF THE PREFERRED EMBODIMENTS

Figure 1:
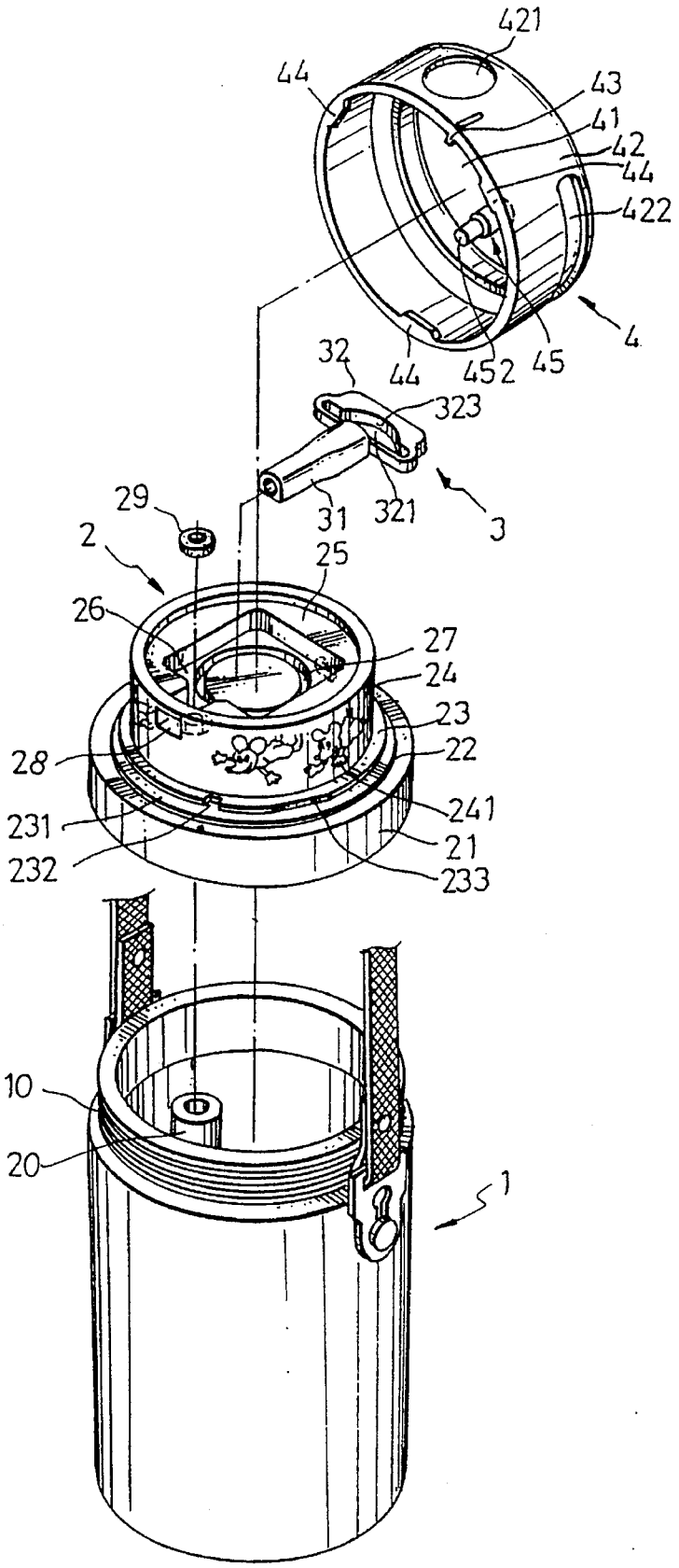
FIG. 1 is an exploded, perspective view of a preferred embodiment of a container of the present invention.
Figure 2:
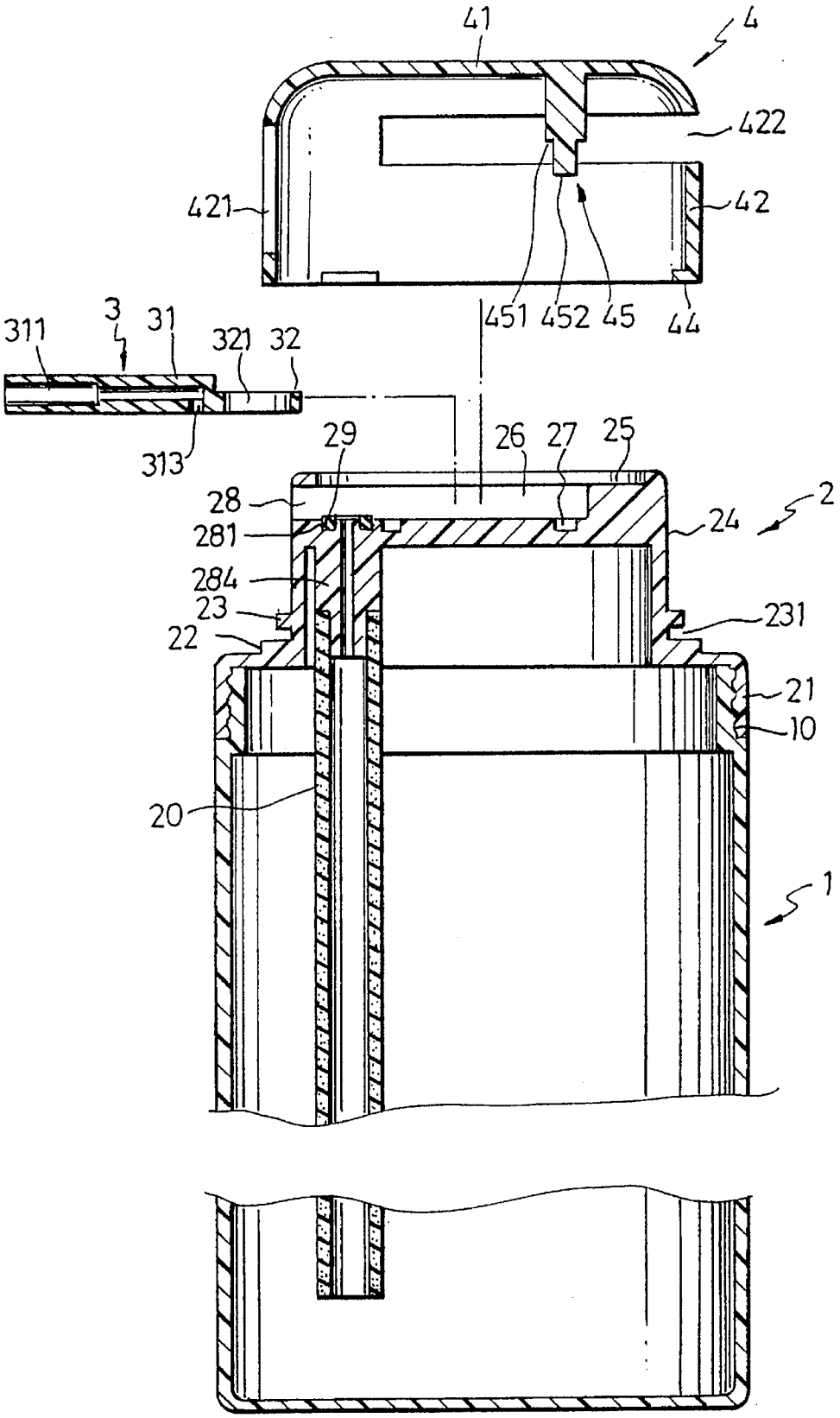
FIG. 2 is an exploded, sectioned, side view of the container of FIG. 1.

Referring to FIGS. 1 through 7, a beverage container in accordance with the present invention includes a body 1 which is a hollow cylindrical member for containing a beverage such as juice or water and has an externally threaded, open upper end 10, a cap 2 screwed onto the upper end 10, an upper straw 3 linearly movable on the cap 2, and a dome 4 rotatable on the cap 2.

Figure 6:
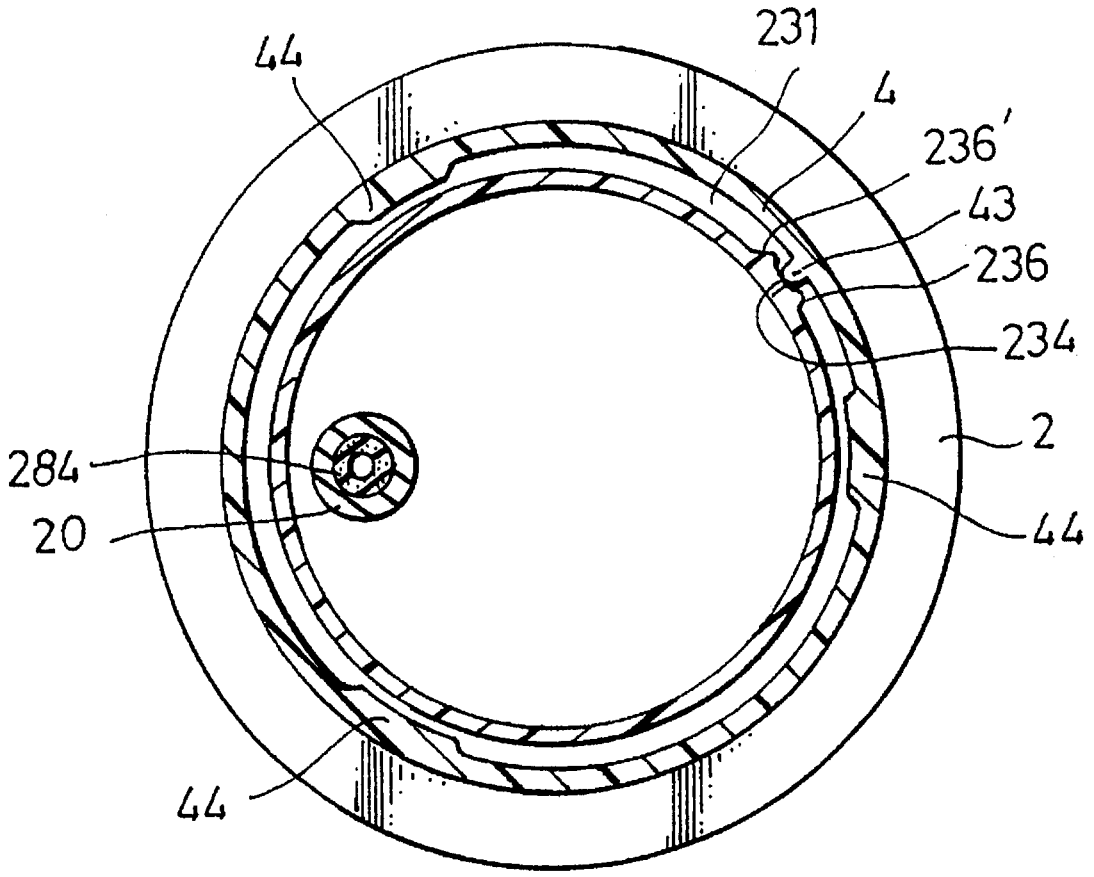
FIG. 6 is a cross section taken along line 6—6' of FIG. 5.

The cap 2 has an internally threaded, open lower cylindrical end 21 for engaging with the upper end 10 of the body 1, a cylindrical side wall 24 of reduced diameter, and a top member 25. Upper and lower circular outwardly extending flanges 22 and 23 with an annular groove 231 therebetween, a notch 232, and two spaced apart cuts 233 are provided on the upper cylindrical portion 24. Two raised beads 236 and 236' are provided on the groove 231 to form a recess 234 as shown in FIG. 6. Cartoon comics 241 or numerals or whatever other objects may be printed on around the outer surface of the side wall 24.

Figure 4:
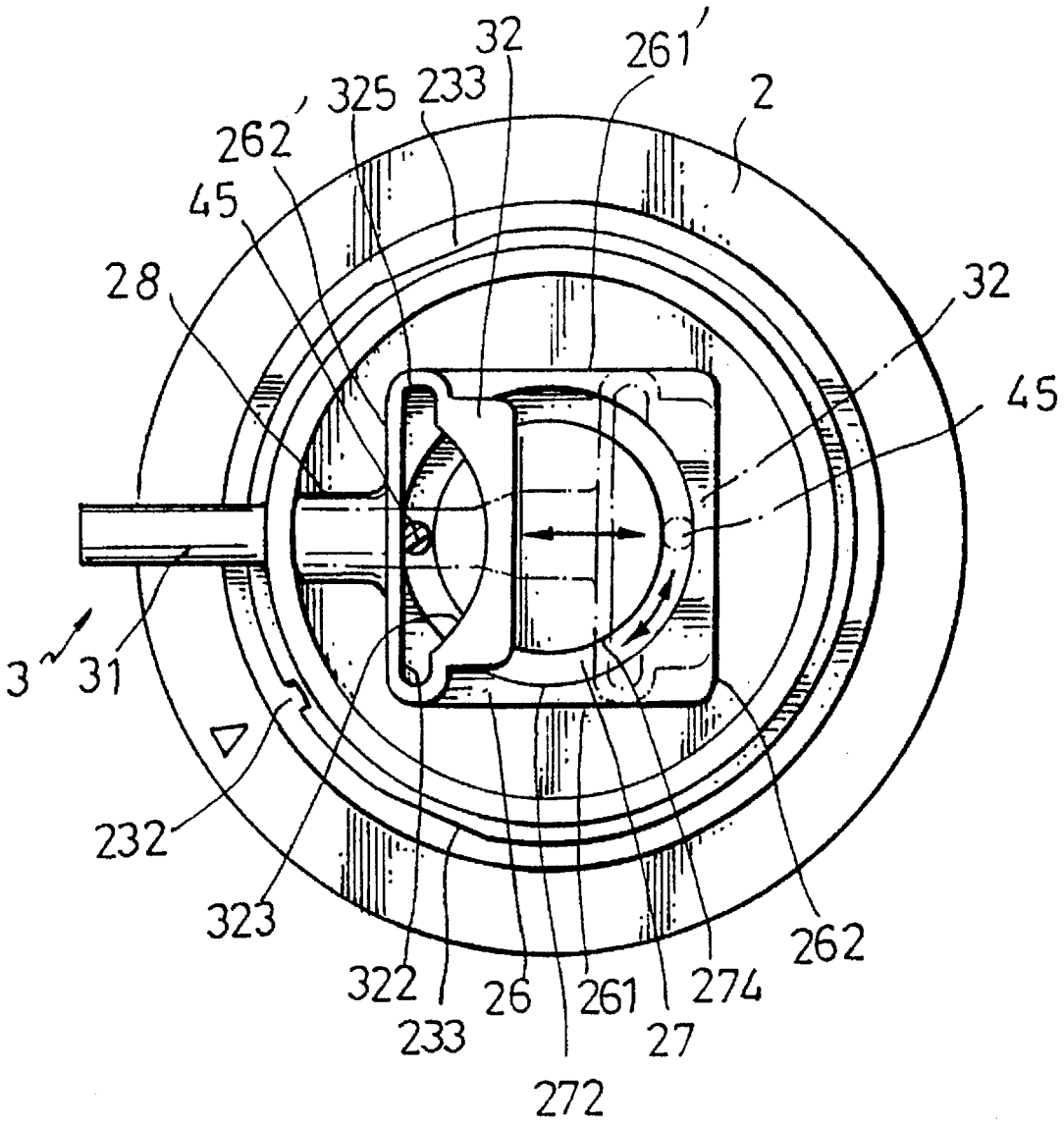
FIG. 4 is a top plan view of the container, showing the motion or the upper straw and the dome.

The top member 25 of the cap 2 has on its top surface a flat rectangular recess 26 for slidably receiving the upper straw 3 and defined by opposite side walls 261 and 261' and opposite side walls 262 and 262' as shown in FIG. 4. A channel 28 parallel to side wall 261 and transversely extending through the side wall 262' of the cap 2 communicates with the recess 26. The top member 25 further comprises a circular groove 27 located in the recess 26 and defined by inner and outer circular walls 272 and 274 coaxial with the cylindrical side wall 24 of the cap 2.

Projected from the bottom of the channel 28 of the top member 25 is a hollow cylinder member to form a nipple 284 to which a dip tube 20 is attached. Preferably, a groove 281 is formed around the top end of the nipple 284 so that an "O"-ring 29 or the like may be engaged into it for leakageproof of the beverage.

Figure 5:
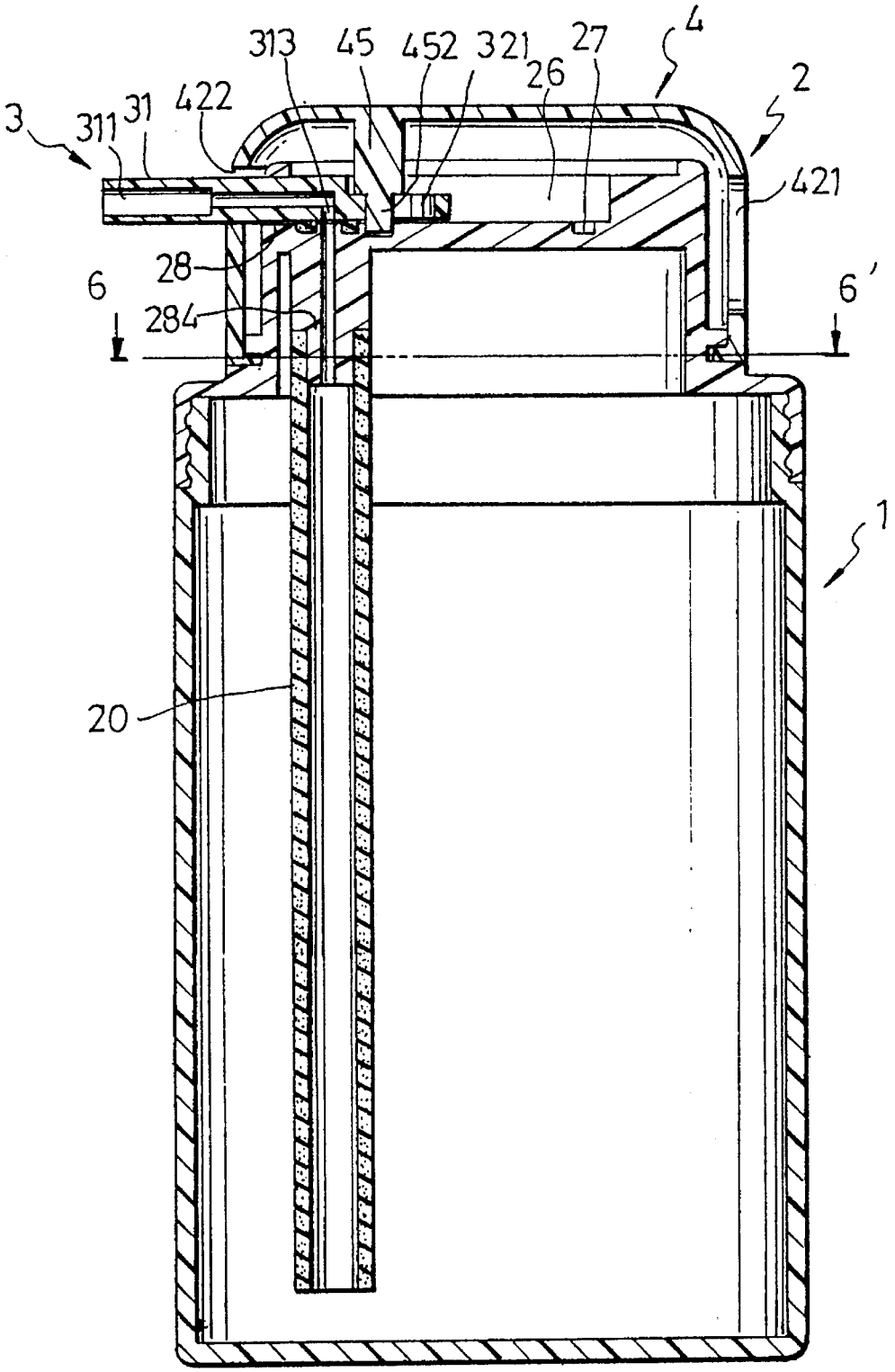
FIG. 5 is a sectioned, side view of the top end of the container in assembled condition, showing the upper straw extending outside the dome.

The upper straw 3 is linearly movably received in the recess 26 of the cap 2 and includes a tube 31 and a transverse guide block 32, forming a T shape. The upper straw 3 is so constructed that the tube 31 is slidable along the channel 28 while the block 32 slidably engages with the side walls 261 and 261' of the recess 26. The tube 31 includes a passage having horizontal section 311 and a vertical section 313 which will be in liquid communication with the nipple 284 when the upper straw 3 is in drinking position as shown in FIG. 5. The block 32 has an aperture 321 mainly defined by a straight wall 322, a curved wall 323 having the same curvature as that of the circular wall 272 of the groove 27, and two transitionary portions 325 connecting the straight wall 322 and the curved wall 323.

The dome 4 is semi-flexible and has a top member 41 and a cylindrical side wall 42. The open edge of the side wall 42 extends radially inward, at three spaced apart positions, a slight amount forming lips 44, with two of them corresponding to the cuts 233 on the flanges 23 of the cap 2. Therefore, the dome 4 can be easily placed on cap 2 by a snap action so that the three lips 44 fits within the annular groove 231 on the side wall 24 of the cap 2, permitting the dome 4 to be rotated relative to the cap 2. A protrusion or bump 43 is provided on the inner surface of the dome 4 for slidably engaging the groove 231 of the cap 2 (see FIG. 6).

Projected from the underside of the top member 41 of the dome 4 is an off-center rod 45 for engaging the aperture 321 of the block 32 of the upper straw 3. The rod 45 has a free end 452 of reduced diameter where a shoulder 451 is formed to provide a stop. The free end 452 passes through the aperture 321 of the upper straw 3 and enters into the circular groove 27 in the recess 26 of the cap 2, with the shoulder 451 abutting the block 32 of the upper straw 3.

The dome 4 further includes an elongated slot 422 partially extending around the hide wall 42 of the dome 4 for allowing the tube 31 of the upper straw 3 to gradually extend therethrough upon rotation of the dome 4.

Figure 3:
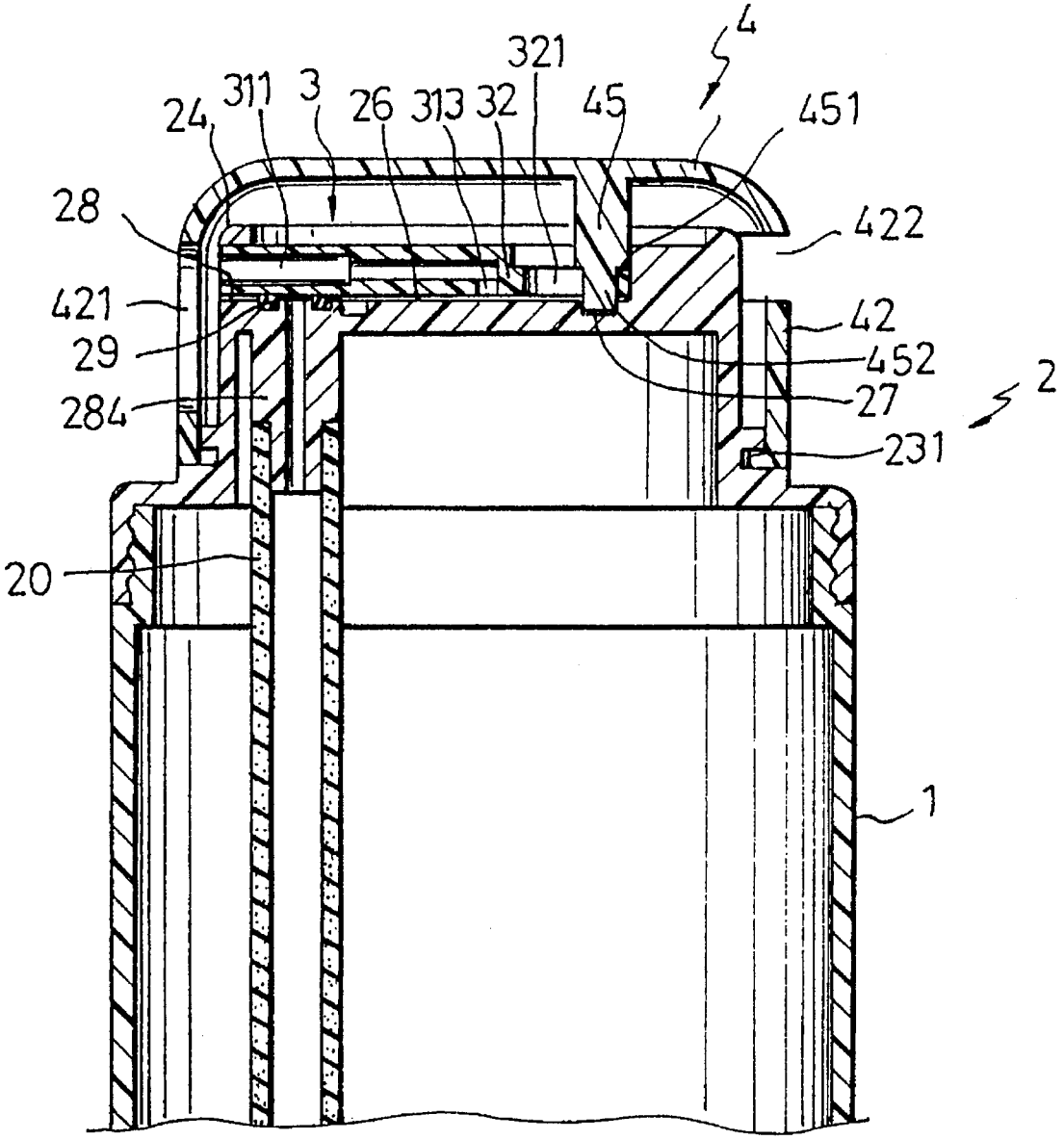
FIG. 3 is a sectioned, side view of the top end of the container of FIG. 1 in assembled condition, showing an upper straw in a non-drinking position.

Thus, the dome 4 can be rotated clockwise or counterclockwise while the rod 45 of the dome 4 slidably engages the straight wall 322 of the block 32 and thus moves the upper straw 3 from a non-drinking position or retracted position shown in FIG. 3 and the phantom line of FIG. 4, to a drinking position wherein the block 32 abuts the wall 262' of the recess 26, and the tube 31 extends through the channel 28 of the cap 2 and the elongate slot 422 of the dome 4 and is in liquid communication with the nipple 284 of the cap 2, as shown in FIG. 5.

When the rod 45 of the dome 4 reaches at the position shown in solid line of FIG. 4, the bump 43 on the dome 4 moves just over one of the raised beads 236 and 236' into the recess 234 and a popping sound is generated because of the deformation and recover of the dome 4, indicating to a user that the dome 4 has been properly located.

Conversely, when the dome 4 is rotated clockwise or counterclockwise from the position shown in FIG. 5 to the position shown in FIG. 3, the rod 45 of the dome 4 slidably engages the curved wall 323 of the block 32 and moves the upper straw 3 till the block 32 abuts the side wall 262 of the recess 26, as shown in the phantom line of FIG. 4. The tube 31 is then stored within the dome 4 and not in liquid communication with the nipple 284.

Figure 7:
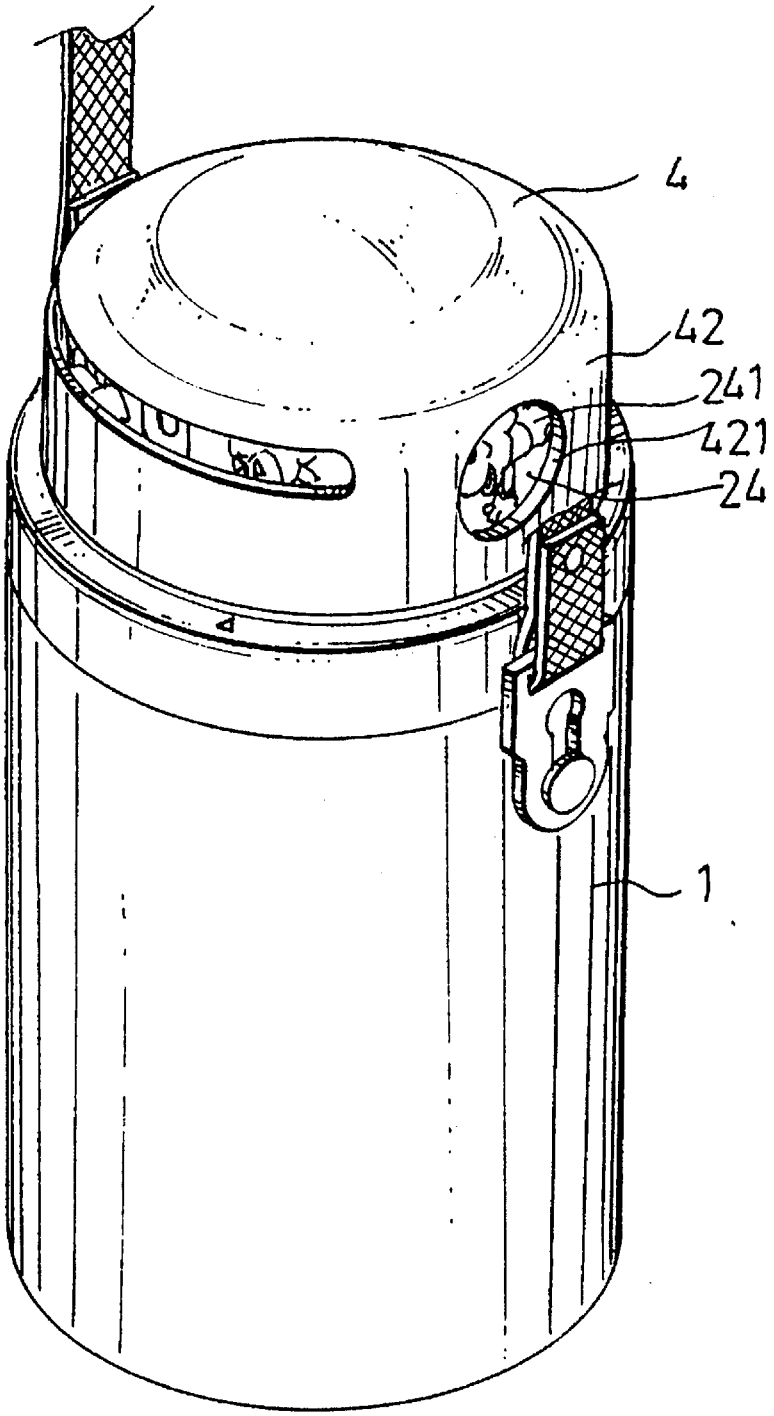
FIG. 7 is a perspective view of the container.

It is advantageous that the upper straw 3 can be moved to extend through the slot 422 and retracted into the dome 4 once during one complete rotation of the dome 4 either in clockwise or counterclockwise direction. Furthermore, as shown in FIG. 7, the user may view the attractive continuous cartoon comics 241 printed around the outer surface of the side wall 24 of the cap 2 through the slot 422 during the rotation of the dome 4. The side wall 42 of the dome 4 may be further provided with a window 421 for making the comics 241 more visible.

I claim:

1. A beverage container comprising:

a body having an open top end;

a removable cap for closing the top end of the body and including a cylindrical side wall having a lateral opening and a top member having a tubular projecting from the underside of the top member to form a nipple;

a dip tube secured to the nipple and extending into the body;

an upper straw means linearly movable in the cap and including a tube section and a guide section;

a dome including a top member and a cylindrical side wall having an elongate slot;

connector means for mounting the dome on the cap for rotational movement relative to the cap; and link means for translating the rotational movement of the dome into the linear movement of the upper straw means on the cap, whereby the rotation of the dome causes the upper straw means to linearly move on the cap between a first position wherein the tube section of the upper straw means extends through the lateral opening of the cap and the elongate slot of the dome and is in liquid communication with the nipple of the cap, and a second position wherein the tube section of the upper straw means is withdrawn within the dome and is not in liquid communication with the nipple of the cap.

2. A container as claimed in claim 1, wherein the link means comprises:

an aperture provided on the upper straw means and defined by at least a straight wall and a curved wall; and an off-center rod projecting from the underside of the top member of the cap for slidably engaging the aperture of the upper straw means.

3. A container as claimed in claim 2, wherein the top member of the cap has a recess for slidably receiving the upper straw means, the recess being provide with a circular groove along which the off-center rod of the dome moves upon rotation of the dome.

4. A container as claimed in claim 1, wherein the connecting means including a groove in the outer surface of the side wall of the cap extending around the side wall.

5. A container as claimed in claim 4, including indicator means for indicating when the dome is rotated to the first position, the indicator means including:

two raised beads provided in the groove of the connector means; and a bump formed on the inner edge of the side wall of the dome for engaging the groove of the connector means.

6. A container as claimed in claim 1, wherein the side wall of the cap has an outer surface on which is printed pattern.

7. A container as claimed in claim 6, wherein the side wall of the dome includes a window for viewing the pattern on the side wall of the cap.

* * * * *